US005370277A

United States Patent [19]

Wallis

[11] Patent Number: 5,370,277

[45] Date of Patent: Dec. 6, 1994

[54] POUR SPOUT CONTAINER

[76] Inventor: Stephen R. Wallis, 1410 E. Hardwick St., Long Beach, Calif. 90807

[21] Appl. No.: 84,920

[22] Filed: Jul. 1, 1993

[51] Int. Cl.[5] ..... B67D 5/32

[52] U.S. Cl. ..... 222/153; 222/530; 222/534

[58] Field of Search ..... 222/51, 153, 185, 531, 222/534, 536, 538, 556, 530, 212, 209, 105, 215

[56] References Cited

U.S. PATENT DOCUMENTS

| | | | |
|---|---|---|---|
| 1,040,675 | 10/1912 | Hertenstein et al. | 222/51 |
| 1,609,674 | 12/1926 | Tefft | 222/215 |
| 2,231,322 | 2/1941 | Cathcart | 222/51 |
| 3,154,222 | 10/1964 | Heckman | 222/215 |
| 3,191,806 | 6/1965 | Schultz et al. | 222/105 |
| 3,702,165 | 11/1972 | Carow et al. | 222/153 |
| 3,782,577 | 1/1974 | Levey | 222/534 |
| 3,874,562 | 4/1975 | Hazard | 222/212 |
| 3,881,643 | 5/1975 | LaVange | 222/534 |
| 4,047,643 | 9/1977 | Hazard | 222/153 |
| 4,570,823 | 2/1986 | Arabian et al. | 222/51 |
| 4,776,475 | 10/1988 | LaVange | 222/153 |

FOREIGN PATENT DOCUMENTS

| | | | |
|---|---|---|---|
| 2987 | of 1899 | United Kingdom | 222/534 |

*Primary Examiner*—Andres Kashnikow
*Assistant Examiner*—Philippe Derakshani

[57] ABSTRACT

A pour spout arrangement for a container, preferably one having a large, flat base and a reduced top portion, which permits draining the contents thereof without having to tip it onto the reduced portion, wherein a pivoting pour spout is provided at the bottom of such base portion; an inclined base member is provided within the container to direct the contents thereof to such pour spout; and a child-proof lock is provided to prevent accidental discharge of such contents through said pour spout means.

2 Claims, 5 Drawing Sheets

POUR SPOUT CONTAINER

BACKGROUND OF THE INVENTION

1. Field of the Invention

The present invention relates to containers and more particularly pertains to such containers which have a large base and a reduced top portion and are designed to contain various fluids such as catsup, shampoo, hand lotion or the like.

2. Description of the Prior Art

The use of pour spouts associated with containers is known in the prior art. More specifically, constructions heretofore devised and utilized for the purpose of passing the contents from a container through a pour spout thereon are known to consist basically of familiar, expected and obvious structural configurations, notwithstanding the myriad of designs encompassed by the crowded prior art which have been developed for the fulfillment of countless objectives and requirements.

Specifically, the problem of removing the dregs of a viscous or thick liquid from a container has not been addressed by the art. Most bottles and similar containers for such fluids are conventionally made with a reduced neck portion which serves to discharge the contents therethrough. When the user gets down to a small amount remaining in the bottle the usual remedy is to tilt the bottle upside down and to lean it against a support to drain from the bottom. Trying to balance the container on its narrow upper end is difficult and frequently results in accidents. At best, this approach will effect removal of most of the contents but, without extreme patience, not all of same. Pour spouts, which are a very convenient way of extracting and directing the contents from a container, are pretty much universally positioned adjacent the top of such container. Typical of this art are U.S. Pat. Nos. 4,944,406; 3,552,607; and 5,004,126. U.S. Pat. No. 4,925,128 utilizes a tubular member extending down into a bottle but such tube is pulled outwardly to form a flexible dispensing nozzle in use and, in any respect, would not serve to dispense viscous material from the side of the bottle.

In this respect, the pour spout construction according to the present invention substantially departs from the conventional concepts and designs of the prior art, and in so doing provides an apparatus primarily developed for the purpose of dispensing the entire contents of a viscous or thick liquid from a container.

Therefore, it can be appreciated that there exists a continuing need for new and improved means which can be utilized for dispensing thick or viscous liquids from a container. In this regard, the present invention substantially fulfills this need.

SUMMARY OF THE INVENTION

In view of the foregoing disadvantages inherent in the known types of containers now present in the prior art, the present invention provides an improved container construction wherein the same can be utilized for complete dispensing of thick or viscous liquids from a container. As such, the general purpose of the present invention, which will be described subsequently in greater detail, is to provide a new and improved pour spout container which has all the advantages of the prior art containers and none of the disadvantages.

To attain this, the present invention essentially comprises: a pour spout arrangement for a container, preferably one having a large, flat base and a reduced top portion, which permits draining the contents thereof without having to tip it onto the reduced portion, wherein a pivoting pour spout means is provided at the bottom of such base portion; means are provided within the container to direct the contents thereof to such pour spout means; and means are provided to prevent accidental discharge of such contents through said pour spout means.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved container which has all the advantages of the prior art containers and none of the disadvantages.

It is another object of the present invention to provide a new and improved pour spout container which may be easily and efficiently manufactured and marketed.

It is a further object of the present invention to provide a new and improved pour spout container which is of a durable and reliable construction.

An even further object of the present invention is to provide a new and improved pour spout container which is susceptible of a low cost of manufacture with regard to both materials and labor, and which accordingly is then susceptible of low prices of sale to the consuming public, thereby making such containers economically available to the buying public.

Still yet another object of the present invention is to provide a new and improved container which provides in the apparatuses and methods of the prior art some of the advantages thereof, while simultaneously overcoming some of the disadvantages normally associated therewith.

Still another object of the present invention is to provide a new and improved pour spout container especially adopted for use with thick or viscous liquids.

Yet another object of the present invention is to provide a new and improved pour spout container which will permit complete draining of a viscous fluid therefore.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
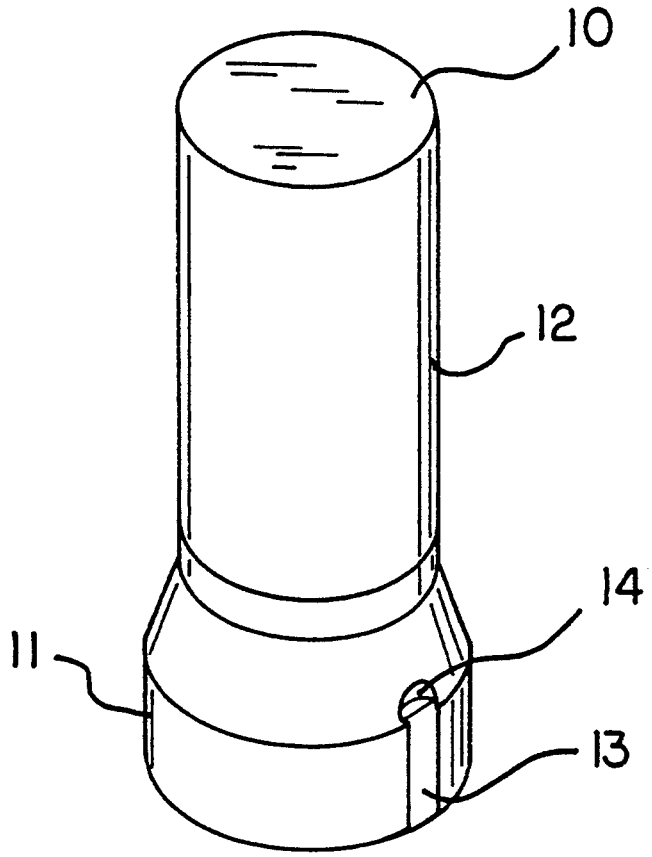
FIG. 1 is a perspective view of a container in closed position embodying the basic details of the present invention.

With reference now to the drawings, and in particular to FIG. 1 thereof, a new and improved pour spout container embodying the principles and concepts of the present invention and generally designated by the reference numeral 10 will be described.

Figure 2:
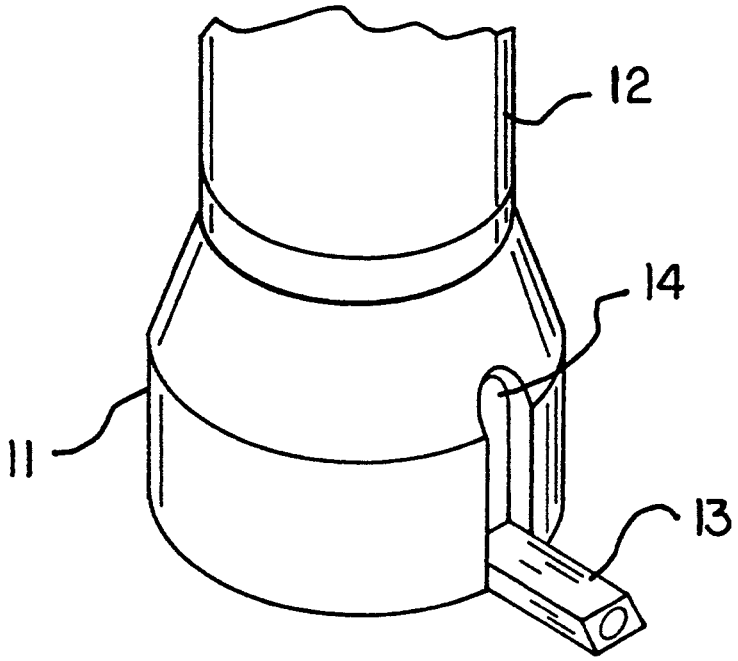
FIG. 2 is an enlarged perspective view of the base of the container of FIG. 1 showing it in open position.

The container 10 preferably, but not necessarily, is asymmetric in shape, i.e. has a large base portion 11 and a similar top or neck portion 12. In the present invention, such base portion 12 has positioned therein a pivoting pour spout means 13. A finger notch 14 is provided to permit the user to operatively engage pour spout means 13. In FIG. 1 such pour spout means 13 is shown in closed position, while in FIG. 2 such means 13 is shown in open or dispensing position.

Figure 3:
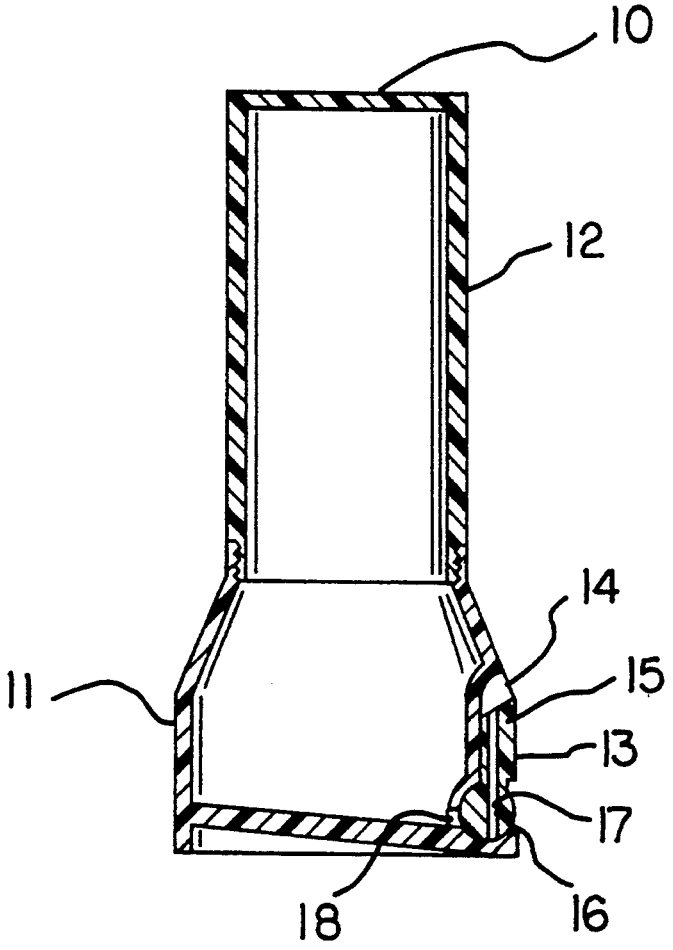
FIG. 3 is a sectional plan view of the container of FIG. 1.
Figure 4:
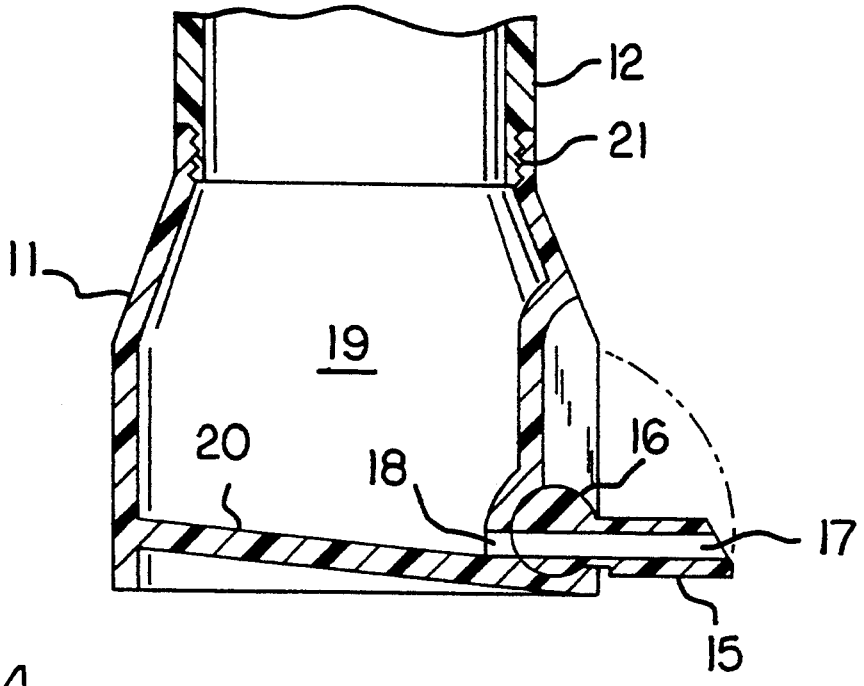
FIG. 4 is an enlarged sectional side plan view of the base of the container of FIG. 1.

FIGS. 3 and 4 illustrate in cross-section the interior of container 10. Pour spout means 13 is shown to consist of a dispenser spout member 15, a pivotal ball member 16 at the inner end of said dispenser spout member 15 and an opening 17 extending through said spout member 15 and said ball member 16 where it provides an entry end for spout member 15. When in the closed position as shown in FIG. 3, such opening 17 is not in communication with the interior of container 10 and none of the contents of such container 10 can escape through the pour spout means 13. When pour spout means 13 is opened as shown in FIG. 4, opening 17 lines up with port 18 in the inner wall of container 10 to form a continuous channel for dispensing the contents from the interior 19 of container 10 through ball member 16 via opening 17 and out dispensing spout member 15. Also, shown in these two Figures is an internal inclined flow directing base member 20 within the interior 19 of container 10. Such base member 20 causes any residual contents within such container 10 to flow downwardly to port 18 in the wall of container 10 and into pour spout means 13. As a practical matter (although not forming part of the present invention) container 10 must be capable of being opened to initially insert the contents into the interior 19 thereof. As shown in these drawings container 10 has the upper portion 12 thereof threadably connected to the base portion 11 by threaded means 21. In most instances it would be expected that the top of upper portion 12 would be open for such insertion and then closed as by adhesive, pressure fit or otherwise to be leak proof.

Figure 5:
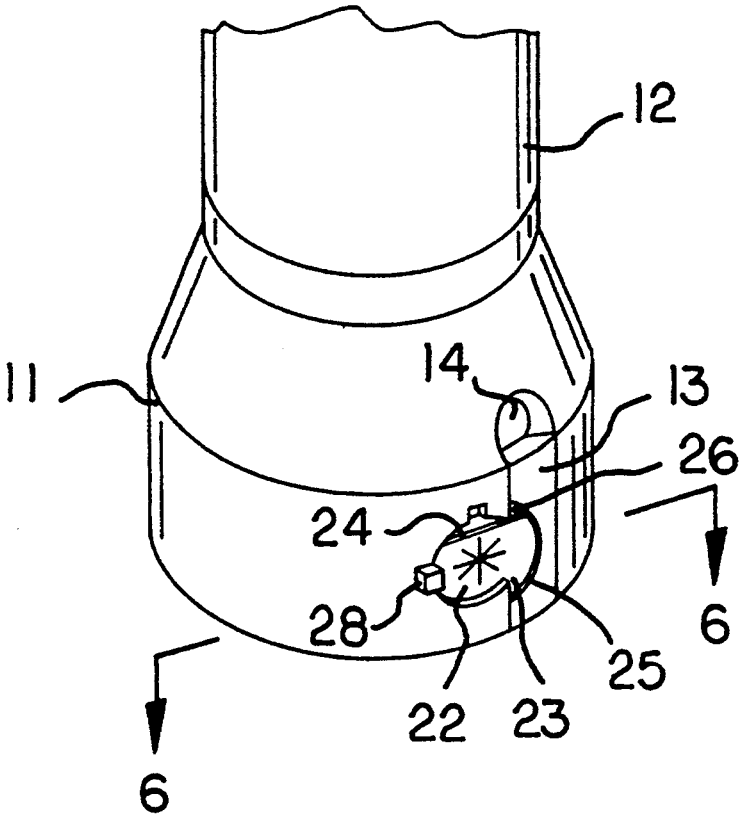
FIG. 5 is a perspective view of a modified container according to the present invention.
Figure 6:
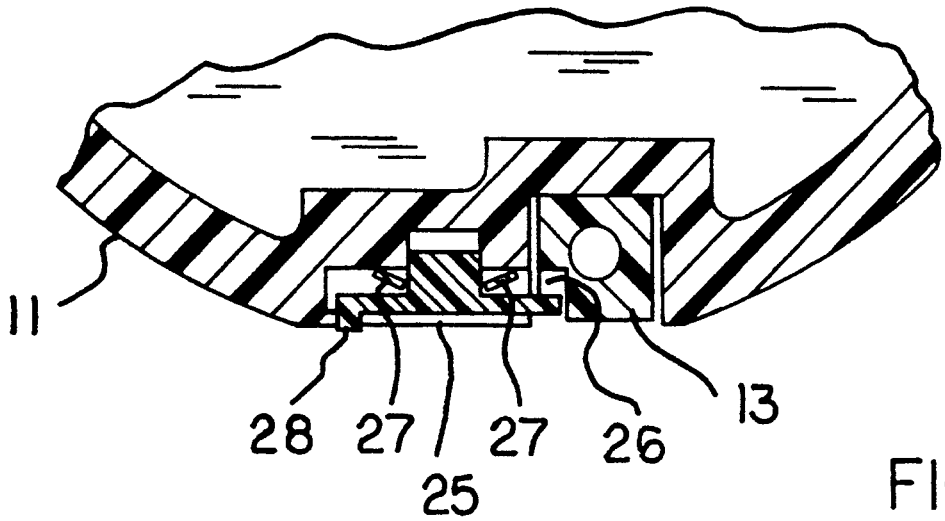
FIG. 6 is a sectional view on line 6—6 of FIG. 5.

FIGS. 5 and 6 illustrate a variation of the present invention wherein a child-proof push and turn locking means 22 is provided to inhibit opening of pour spout means 13. As shown in these drawings, locking means 22 consists of a retractable plate member 23 having an upper straight edge 24 and an arcuate side edge 25. When in closed position as shown in these figures, the curved side edge 25 of means 22 extends within recess 26 in pour spout means 13 and across the normal path of travel of pour spout means 13 preventing it from opening. Pushing inwardly on plate member 23 will depress spring members 27 (shown as flexible, resilient plastic arms or the like) and cause the projecting lock member 28 to be pushed free of the recess in base portion 11 through which it extends when in the closed position as shown. This will permit locking means 22 to be rotated in a clockwise direction to free up pour spout means 13 to open.

Figure 7:
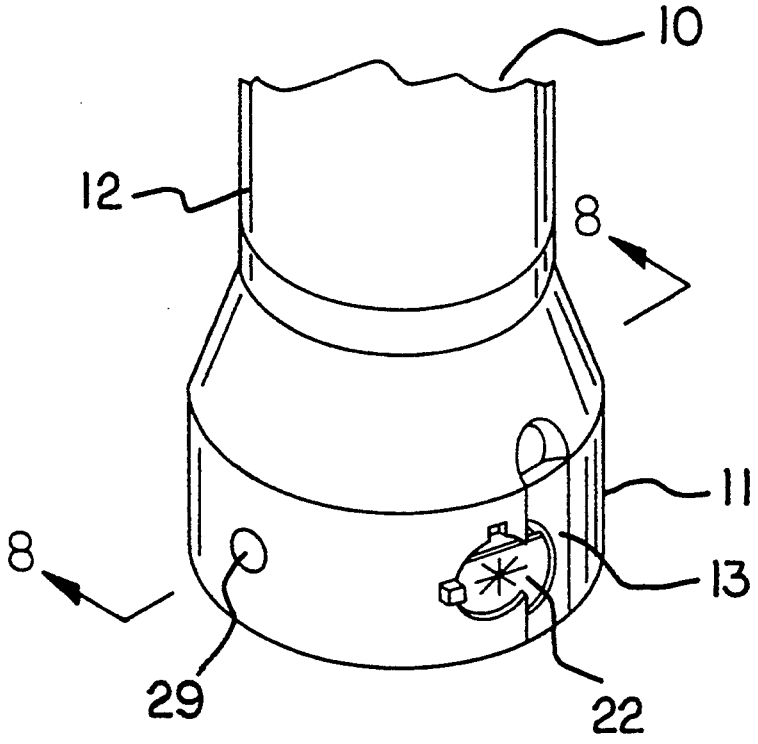
FIG. 7 is a perspective view of the container of FIG. 5 showing an additional modification thereof.
Figure 8:
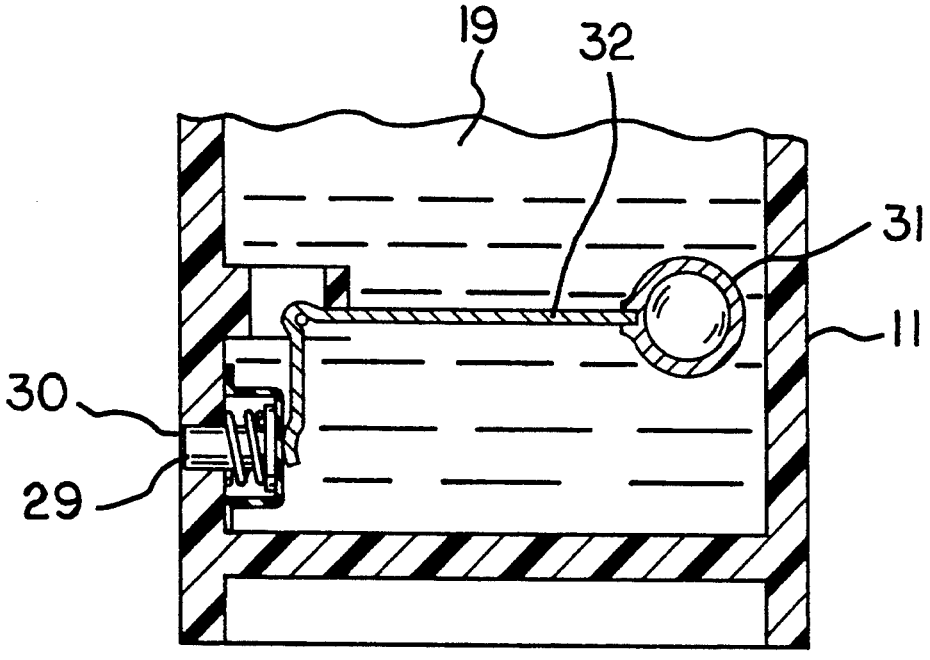
FIG. 8 is a sectional view on line 8—8 of FIG. 7.

FIGS. 7 and 8 show an optional addition to the container 10 shown in FIGS. 5 and 6. Here, a low liquid level indicator button 27 capable of extending as a liquid tight seal through port 30 in base portion 11 is provided. Within the interior 19 of container 10 a float ball member 31 is mounted with connecting linkage 32 extending therefrom to the base of indicator button 29. Such button 29 is spring loaded as at 33 to normally keep such button 29 retracted within the base portion as shown in FIG. 8. When the level of the liquid within the interior 19 of container 10 drops below the normal flotation level of float ball member 31, such ball member 31 will likewise drop, causing linkage 32 to push indicator button 29 outwardly from port 30, thus alerting the user to the decreasing level of contents within container 10. If desired, indicia may be placed on said button 29 indicating the height of the remaining liquid or the remaining volume measurement thereof.

Figure 9:
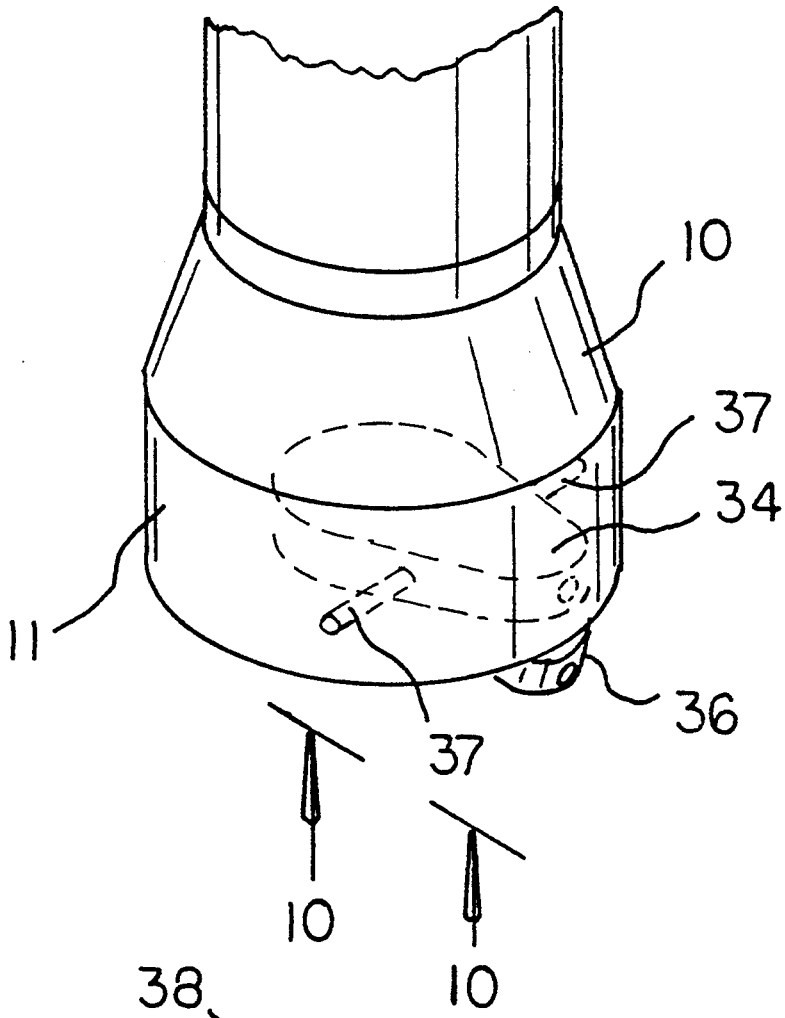
FIG. 9 is a perspective view showing a modified pour spout.
Figure 10:
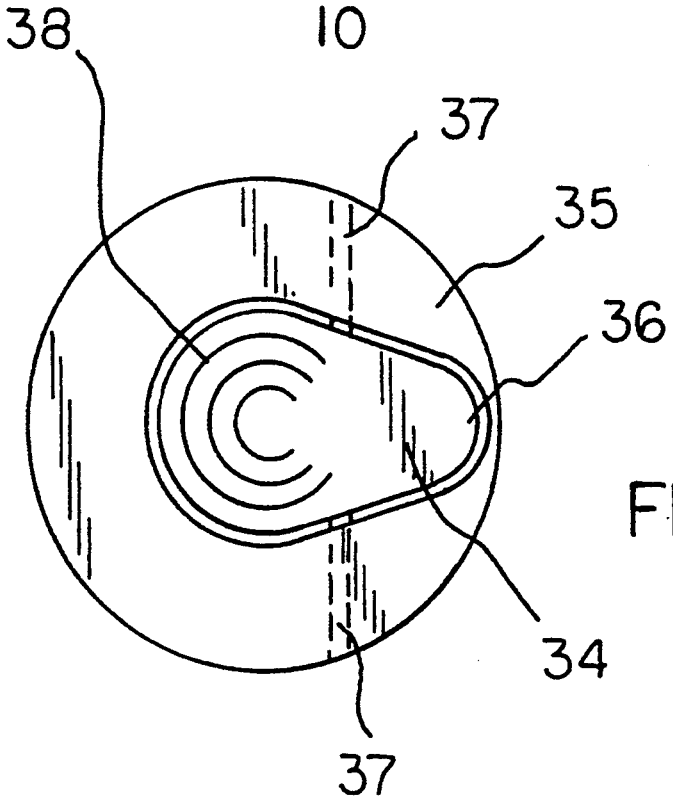
FIG. 10 is a bottom view of the container of FIG. 9.

FIGS. 9 and 10 illustrate a modification of the pour spout means 13 of the previous drawings. Herein the pour spout, designated as 34, is located in the flat bottom portion 35 of the base member 11 of container 10. FIG. 9 illustrates pour spout 34 in closed position (broken lines) and with the dispensing spout end 36 of such pour spout 34 in operating position. Again, pour spout 34 is pivotally mounted so as to open and close as by pivot arms 37 extending from pour spout means 34. Operated by finger pressure on the pad end 38 of pour spout means 34, the pad end 38 pushes up into the base 11 of container 10 in liquid sealing relationship between the walls of pour spout 34 and the interior portion of the flat bottom 35 to allow liquid entering the back of pour spout 34 to be dispensed out the dispensing spout 36 thereof. Recessing of pad end 38 and dispensing spout 36 slightly within the flat bottom 35 provides the means to prevent accidental discharge of the contents of container 10.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pour spout container particularly designed to dispense the entire contents of viscous liquids therefrom, said pour spout container comprising:

a container having a neck portion of a first diameter and a base portion of a second diameter, wherein said second diameter is substantially greater than said first diameter such that said container will resist tipping over, said neck portion being threadably separable from said base portion to facilitate filling of said container, said container having an interior with a port extending through said base portion, with said base portion having an inclined flow directing member having an upper and lower end within said interior of said container which directs contents within said container to flow downwardly to said port; and, a pour spout connected at said inclined flow directing member lower end having an opening extending longitudinally therethrough and a ball member, with said ball member being pivotally mounted to said base portion adjacent to said port such that fluid communication between said opening and said port is precluded when said pour spout is positioned in a first, upward position, and fluid communication between said opening and said port is permitted when said pour spout is in positioned in a second, outward position such that said contents of said container are dispensed through said pour spout with said container in an upright position.

2. The pour spout container as recited in claim 1, and further comprising locking means for locking said pour spout in said first, upward position, said locking means comprising a retractable plate having a straight edge and an arcuate edge, said retractable plate being rotatably, movably mounted to said base portion and laterally positioned relative to said pour spout, said retractable plate further having a projecting lock member engaged to a recess in said base portion, wherein said arcuate edge engages said pour spout when said projecting lock member is engaged to said recess of said base member, whereby said retractable plate can be biased axially inwardly in a direction orthogonal to a longitudinal, vertical axis of said container to disengage said projecting lock member from said recess, with said locking plate being subsequently rotatable to position said arcuate edge away from said pour spout such that said pour spout can be pivoted past said straight edge of said locking plate into said second, outward position.

* * * * *